US006805068B1

(12) United States Patent
Tossavainen

(10) Patent No.: US 6,805,068 B1
(45) Date of Patent: Oct. 19, 2004

(54) HYDROFOIL SYSTEM FOR LIFTING A BOAT PARTIALLY OUT OF WATER AN AMOUNT SUFFICIENT TO REDUCE DRAG

(76) Inventor: Raimer Tossavainen, P.O. Box 188, Lakebay, WA (US) 98349

( * ) Notice: Subject to any disclaimer, the term of this patent is extended or adjusted under 35 U.S.C. 154(b) by 0 days.

(21) Appl. No.: 10/634,981

(22) Filed: Aug. 5, 2003

(51) Int. Cl.[7] ..... B63B 1/22; B63B 1/24

(52) U.S. Cl. ..... 114/274; 114/280; 114/284; 114/285

(58) Field of Search ..... 114/271, 274, 114/280–286, 288–291, 145 R, 145 A; D12/309

(56) References Cited

U.S. PATENT DOCUMENTS

| | | | | | |
|---|---|---|---|---|---|
| 2,099,492 | A | * | 11/1937 | Luders | 114/285 |
| 2,257,405 | A | * | 9/1941 | Von Burtenbach | 114/274 |
| 2,584,347 | A | * | 2/1952 | Hazard | 114/280 |
| 2,720,180 | A | * | 10/1955 | Von Schertel | 114/282 |
| 2,832,304 | A | * | 4/1958 | Elyosius et al. | 114/280 |
| 2,926,623 | A | * | 3/1960 | Leehey | 114/274 |
| 2,991,747 | A | * | 7/1961 | Bader et al. | 114/282 |
| 3,058,442 | A | * | 10/1962 | Curtis | 114/285 |
| 3,092,062 | A | | 6/1963 | Savitsky | |
| 3,342,155 | A | * | 9/1967 | Hook | 114/280 |
| 3,345,968 | A | * | 10/1967 | Bailey | 114/280 |
| 3,354,857 | A | * | 11/1967 | Hobday | 114/282 |
| 3,391,667 | A | * | 7/1968 | Lo Bue | 114/285 |
| 3,577,948 | A | | 5/1971 | Frey | |
| 3,651,775 | A | | 3/1972 | Kock | |
| 3,693,570 | A | * | 9/1972 | Erlykin et al. | 114/274 |
| 4,056,074 | A | * | 11/1977 | Sachs | 114/280 |
| 4,058,076 | A | * | 11/1977 | Danahy | 114/281 |
| 4,203,381 | A | * | 5/1980 | Wankel | 114/274 |
| 4,597,742 | A | * | 7/1986 | Finkl | 440/61 R |
| 4,748,929 | A | * | 6/1988 | Payne | 114/280 |
| 4,756,265 | A | | 7/1988 | Lane | |
| 4,915,048 | A | | 4/1990 | Stanford | |
| 4,967,682 | A | * | 11/1990 | O'Donnell | 114/286 |
| 5,339,761 | A | * | 8/1994 | Huang | 114/274 |
| 5,404,830 | A | | 4/1995 | Ligozio | |
| 5,645,009 | A | * | 7/1997 | Lexau | 114/274 |
| 5,806,455 | A | * | 9/1998 | Buzzi | 114/286 |
| 6,146,224 | A | | 11/2000 | McCarthy | |
| 6,164,235 | A | | 12/2000 | Hoppe | |
| 6,354,237 | B1 | | 3/2002 | Gaynor et al. | |

FOREIGN PATENT DOCUMENTS

| | | | | |
|---|---|---|---|---|
| JP | 01212695 A | * | 8/1989 | B63H/25/38 |
| JP | 08034387 A | * | 2/1996 | B63B/1/24 |

* cited by examiner

*Primary Examiner*—S. Joseph Morano
*Assistant Examiner*—Ajay Vasudeva
(74) *Attorney, Agent, or Firm*—Richard L. Miller

(57) ABSTRACT

A hydrofoil system for lifting a boat out of water an amount sufficient to reduce drag while still allowing the boat to be powered by a conventional inboard-outboard drive. The hydrofoil system includes a front hydrofoil unit, a center hydrofoil unit, and a pair of rear hydrofoil units. The front hydrofoil unit includes a hydrofoil portion that dependingly mounts to a mounting portion thereof that depends from the bottom of the hull at the bow thereof. The center hydrofoil unit includes a hydrofoil that dependingly extends equidistantly outwardly from a pair of stanchions thereof that depend from the bottom of the hull at the substantial center thereof. Each rear hydrofoil unit includes a hydrofoil that dependingly extends equidistantly outwardly from a pair of stanchions thereof that depend from port and starboard trim tab units of the hull, respectively.

20 Claims, 3 Drawing Sheets

HYDROFOIL SYSTEM FOR LIFTING A BOAT PARTIALLY OUT OF WATER AN AMOUNT SUFFICIENT TO REDUCE DRAG

BACKGROUND OF THE INVENTION

1. Field of the Invention

The present invention relates to a hydrofoil system. More particularly, the present invention relates to a hydrofoil system for lifting a boat out of water an amount sufficient to reduce drag while still allowing the boat to be powered by a conventional inboard-outboard drive.

2. Description of the Prior Art

Numerous innovations for hydrofoils have been provided in the prior art that will be described. Even though these innovations may be suitable for the specific individual purposes to which they address, however, they differ from the present invention.

A FIRST EXAMPLE, U.S. Pat. No. 3,092,062 to Savitsky teaches in combination with a water borne vessel, a passive self-compensating hydrofoil control system comprising a substantially vertical hydrofoil strut member and a hydrofoil plane, said vertical strut member being connected at its upper end to the hull of said vessel, said hydrofoil plane being disposed at the lower end of said strut member and operable to maintain a hydrodynamic lift of the vessel to a minimum submergence of the hydrofoil plane below the free water surface at cruise speed of the vessel, each of said strut and plane members having integral pivotal flaps defining at least a portion of the trailing edges of said members, said pivotal flap of the strut member terminating at its lower end at a height above said hydrofoil plane which is greater than said minimum submergence, and mechanical linkage means interconnecting both of said pivotal flaps and operable, on application of unbalanced external forces to one flap causing it to pivot, to apply to the other flap a force acting to move said other flap toward a position for equalizing the forces applied to both flaps.

A SECOND EXAMPLE, U.S. Pat. No. 3,577,948 to Frey teaches an attachment for a power boat which fits on the transom or stern of the boat and comprises a pair of trim tabs hinged at the transom and extending rearwardly therefrom, and which may be swung vertically simultaneously to different angular positions to trim the boat so that it operates at the proper attitude regardless of its loading. The tabs are so formed that they also bring about lateral stability as well as impart the proper attitude to the boat. Furthermore, the tabs are positively moved vertically up or down to their selected angular positions.

A THIRD EXAMPLE, U.S. Pat. No. 3,651,775 to Kock teaches a hydrofoil system attached to a hull of a vessel. The foil are attached to the hull of a vessel by means of non-lifting struts and each foil comprises a main lifting foil portion which consists of submerged middle section and two upwardly and outwardly inclined side sections which control the end position of the lift. In a spaced relation and parallel to the inclined sections, two auxiliary upper lifting foil portions are attached on each side of the hull for supporting the lifting action and stabilizing the vessel.

A FOURTH EXAMPLE, U.S. Pat. No. 4,756,265 to Lane teaches a thrust collar for mounting around the upper portion of the propeller of an inboard/outboard engine. Each thrust collar supports a horizontal hydrofoil wing extending laterally from the collar. A second, similar wing can be provided on an opposing side of the collar. Where the collar is used in pairs on paired engines on a catamaran hull, a single hydrofoil wing can be supported between the thrust collars. The thrust collar is preferably used in conjunction with hull lifting structures. One hull mounted hydrofoil structure is supported at the lower end of the strut extending and includes a generally curvilinear gull-wing shaped lower surface. For V-type hulls, a pair of elongated mechanical lifting structures, symmetrically positioned on either side of the keel substantially in the vicinity of the keel are attached to the hull so as to extend generally traversedly to the sloping side surfaces of the hull intersecting at the keel. These lifting structures have a length many times greater than their maximum transverse dimension and preferably extend from a position approximately a midship beneath the hull to the stern of the hull. Retractable hydrofoil assemblies are described for drawing a strut supporting a hydrofoil wing into a boat or rotating the strut upward into a tunnel beneath the boat in the case of a catamaran hull.

A FIFTH EXAMPLE, U.S. Pat. No. 4,915,048 to Stanford teaches planing vessels of improved performance capability and methods for improving such performance and foils which may be associated with planing vessels for providing improved performance capability. A dynamic downward force generated as the vessel moves through water, preferably by a foil, is imposed on the vessel, with the locus of the force positioned, in the traverse direction, at the longitudinal vertical centerline plane of the vessel. In the longitudinal direction the locus of the dynamic force is positioned, relative to the other forces acting fore-to-aft on the vessel, to decrease the trim angle of the vessel, desirably to less than two degrees. Vessel wetted surface configurations are provided for stable and efficient operation at low trim angles, including the following. A deep draft, fine entrance which minimizes rise at the bow experienced with conventional planing vessels and assists in maintaining laminarity of flow at the planing surfaces. A foil extending along the bowpeak below the waterline and spaced forwardly thereof to streamline the flow passing the bow to thereby decrease spray and turbulence. A skeg extending downward at the bottom of the hull at the entrance along the longitudinal centerline plane which improves directional stability and also assists in maintaining flow laminarity. A swept back wing located at the entrance, preferably mounted at the lower margin of the skeg positioned with an angle of attack which generates an upward force to improve the vessel stability against pitch and yaw in disturbed water. An aftmidships planing floor having a rise from midships to the stern trailing edge desirably from 50% to 100% of the midships draft improves the stability of the vessel when operated at trim. A release floor extending aftward 5 to 25% of the waterline length of the vessel, preferably from a transverse step and rising over this length 10 to 50% of the midships draft to a transverse trailing edge. The trailing edge and the release floor, in the transverse direction, are parallel with base plane of the vessel. The pressure release floor reduces the pressure on the aftward flow to separation at the trailing edge in a gradual and uniform manner which reduces drag. The foil to generate a downward force in the flow desirably is positioned below the stern trailing edge and contoured to produce minimum induced drag and to divert the flow at its trailing edge downwardly so as to reduce turbulence and drag at the stern.

A SIXTH EXAMPLE, U.S. Pat. No. 5,404,830 to Ligozio teaches a displacement boat hull having the outboard surfaces of its wetted portion designed with a deep-V shape, and having at least one pair of retractable hydrofoil fins positioned in respective pockets along those outboard surfaces at a predetermined distance above the keel. When extended, the fins are positioned at fixed angles relative to the hull, and at least one pair of fins is positioned in proximity to the stern. In a preferred embodiment, a conventional deep-V semi-displacement hull is modified to increase the conventional maximum draft with an unusually steep angle (at least 30 degrees to 40 degrees) for the initial deadrise from the keel upward toward the chine; and at least two pairs of fins are disposed on opposite sides of the hull, with an aft pair being positioned in proximity to the stern and another pair being positioned forward of the stern pair, preferably just forward of the boat's center of balance. The fins are continuously adjustable from (a) a fully-retracted in-pocket position to a fully-extended position laterally outboard of the hull. The invention can be used to modify catamaran and tri-hulls as well as mono-hulls, and it is compatible with all types of propulsion systems. Such modifications provide a remarkably low center of gravity that assures excellent balance and stability at all times, particularly when operating with the fins, while achieving higher speeds and requiring less power.

A SEVENTH EXAMPLE, U.S. Pat. No. 6,164,235 to Hoppe teaches a hydrofoil equipment water craft comprising at least one hull member, terminating at a bow and a stern, a front hydrofoil member arranged in the zone of the bow of the hull, at least partially below the hull; and a rear hydrofoil member positioned to the rear of the longitudinal center of gravity (LCG) of the hull, the front hydrofoil member being at least partially offset transversely relative to the rear hydrofoil member so that the front hydrofoil or rear hydrofoil are at least partially disposed in separate longitudinal flow streams.

AN EIGHTH EXAMPLE, U.S. Pat. No. 6,354,237 B1 to Gaynor et al. teaches a trim tab control system in which four buttons or switches are provided for the marine operator in which the operator can select to raise the bow, raise the stern, raise the port side of the boat, or raise the stern side of the boat in relative terms, and the system will automatically position the trim tabs to most efficiently achieve the operator's demanded change in position of the marine vessel.

It is apparent that numerous innovations for hydrofoils have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hydrofoil system for lifting a boat out of water an amount sufficient to reduce drag while still allowing the boat to be powered by a conventional inboard-outboard drive that avoids the disadvantages of the prior art.

ANOTHER OBJECT of the present invention is to provide a hydrofoil system for lifting a boat out of water an amount sufficient to reduce drag while still allowing the boat to be powered by a conventional inboard-outboard drive that is simple and inexpensive to manufacture.

STILL ANOTHER OBJECT of the present invention is to provide a hydrofoil system for lifting a boat out of water an amount sufficient to reduce drag while still allowing the boat to be powered by a conventional inboard-outboard drive that is simple to use.

BRIEFLY STATED, STILL YET ANOTHER OBJECT of the present invention is to provide a hydrofoil system for lifting a boat out of water an amount sufficient to reduce drag while still allowing the boat to be powered by a conventional inboard-outboard drive. The hydrofoil system includes a front hydrofoil unit, a center hydrofoil unit, and a pair of rear hydrofoil units. The front hydrofoil unit includes a hydrofoil portion that dependingly mounts to a mounting portion thereof that depends from the bottom of the hull at the bow thereof. The center hydrofoil unit includes a hydrofoil that dependingly extends equidistantly outwardly from a pair of stanchions thereof that depend from the bottom of the hull at the substantial center thereof. Each rear hydrofoil unit includes a hydrofoil that dependingly extends equidistantly outwardly from a pair of stanchions thereof that depend from port and starboard trim tab units of the hull, respectively.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
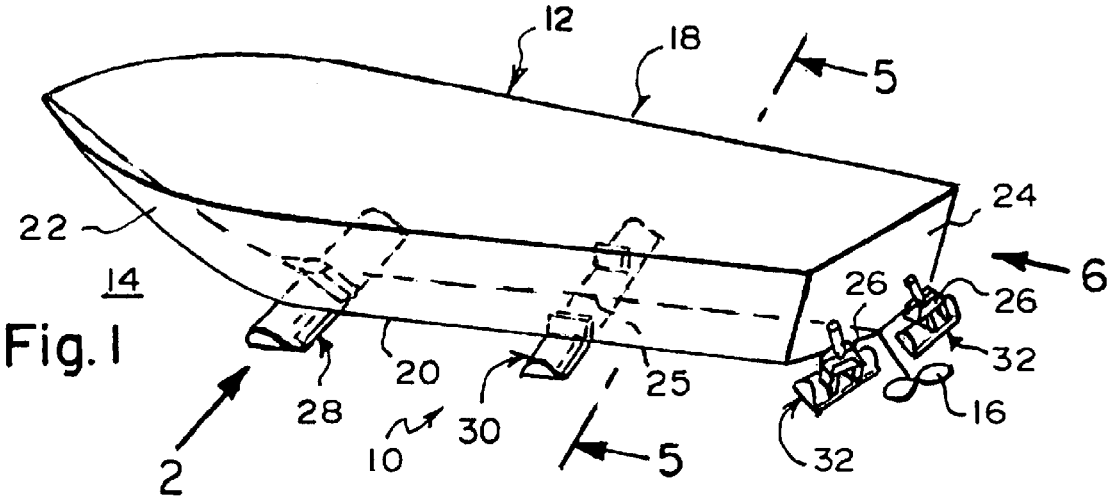
FIG. 1 is a diagrammatic perspective view of the present invention installed on a hull of a boat.

10 hydrofoil system of present invention for lifting boat 12 out of water 14 amount sufficient to reduce drag while still allowing boat 12 to be powered by conventional inboard-outboard drive 16
12 boat
14 water
16 conventional inboard-outboard drive
18 hull of boat 12
20 bottom of hull 18 of boat 12
22 bow of hull 18 of boat 12
24 stern of hull 18 of boat 12
25 substantial center of hull 18 of boat 12

26 port and starboard trim tabs of stern 24 of hull 18 of boat 12

28 front hydrofoil unit for depending from bottom 20 of hull 18 of boat 12 at bow 22 thereof

30 center hydrofoil unit for depending from bottom 20 of hull 18 of boat 12 at substantial center 25 thereof

32 pair of rear hydrofoil units for depending from port and starboard trim tab units 26 of stern 24 of hull 18 of boat 12, respectively

34 mounting portion of front hydrofoil unit 28 for mounting to, and for depending from, bottom 20 of hull 18 of boat 12 at bow 22 thereof

36 hydrofoil portion of front hydrofoil unit 28

38 pair of upper plates of mounting portion 34 of front hydrofoil unit 28 for mounting to, and for depending from, bottom 20 of hull 18 of boat 12 at bow 22 thereof

40 common edge of pair of upper plates 38 of mounting portion 34 of front hydrofoil unit 28

41 through bores in pair of upper plates 38 of mounting portion 34 of front hydrofoil unit 28

42 stanchion of mounting portion 34 of front hydrofoil unit 28

44 lower plate of mounting portion 34 of front hydrofoil unit 28

45 through bores in lower plate 44 of mounting portion 34 of front hydrofoil unit 28

46 pair of struts of mounting portion 34 of front hydrofoil unit 28

48 upper plate of hydrofoil portion 36 of front hydrofoil unit 28

50 through bores in upper plate 40 of hydrofoil portion 36 of front hydrofoil unit 28

52 upper bolts

54 extension of hydrofoil portion 36 of front hydrofoil unit 28

56 lower plate of hydrofoil portion 36 of front hydrofoil unit 28

58 through bores in lower plate 56 of hydrofoil portion 36 of front hydrofoil unit 28

60 stanchion of hydrofoil portion 36 of front hydrofoil unit 28

62 through bores in stanchion 60 of hydrofoil portion 36 of front hydrofoil unit 28

64 lower bolts

66 hydrofoil of hydrofoil portion 36 of front hydrofoil unit 28

68 pair of stanchions of center hydrofoil unit 30 for mounting to, for depending from, and for straddling, bottom 20 of hull 18 of boat 12 at substantial center 25 thereof

70 hydrofoil of center hydrofoil unit 30

72 pair of stanchions of each rear hydrofoil unit of pair of rear hydrofoil units 32 for mounting to, and for depending from, associated one of port and starboard trim tabs 26 of rear 24 of hull 18 of boat 12

74 hydrofoil of each rear hydrofoil unit of pair of rear hydrofoil units 32

76 vertical portion of each stanchion of pair of stanchions 72 of each rear hydrofoil unit of pair of rear hydrofoil units 32

78 horizontal portion of each stanchion of pair of stanchions 72 of each rear hydrofoil unit of pair of rear hydrofoil units 32

80 through bores in horizontal portion 78 of each stanchion of pair of stanchions 72 of each rear hydrofoil unit of pair of rear hydrofoil units 32 for receiving screws (not shown) for attaching pair of rear hydrofoil units 32 to port and starboard trim tabs 26, respectively.

DETAILED DESCRIPTION OF THE PREFERRED EMBODIMENT

Referring now to the figures, in which like numerals indicate like parts, and particularly to FIG. 1, the hydrofoil system of the present invention is shown generally at 10 for lifting a boat 12 out of water 14 an amount sufficient to reduce drag while still allowing the boat 12 to be powered by a conventional inboard-outboard drive 16. The boat 12 has a hull 18 with a bottom 20, a bow 22, a stern 24 with port and starboard trim tabs 26, and a substantial center 25 which is intermediate the bow 22 of the hull 18 and the stern 24 of the hull 18.

The hydrofoil system 10 comprises a front hydrofoil unit 28, a center hydrofoil unit 30, and a pair of rear hydrofoil units 32. The front hydrofoil unit 28 is for depending from the bottom 20 of the hull 18 at the bow 22 thereof. The pair of rear hydrofoil units 32 are for depending from the port and starboard trim tab units 26 of the hull 18, respectively. The center hydrofoil unit 30 is for depending from the bottom 20 of the hull 18 at the substantial center 25 thereof.

Figure 2:
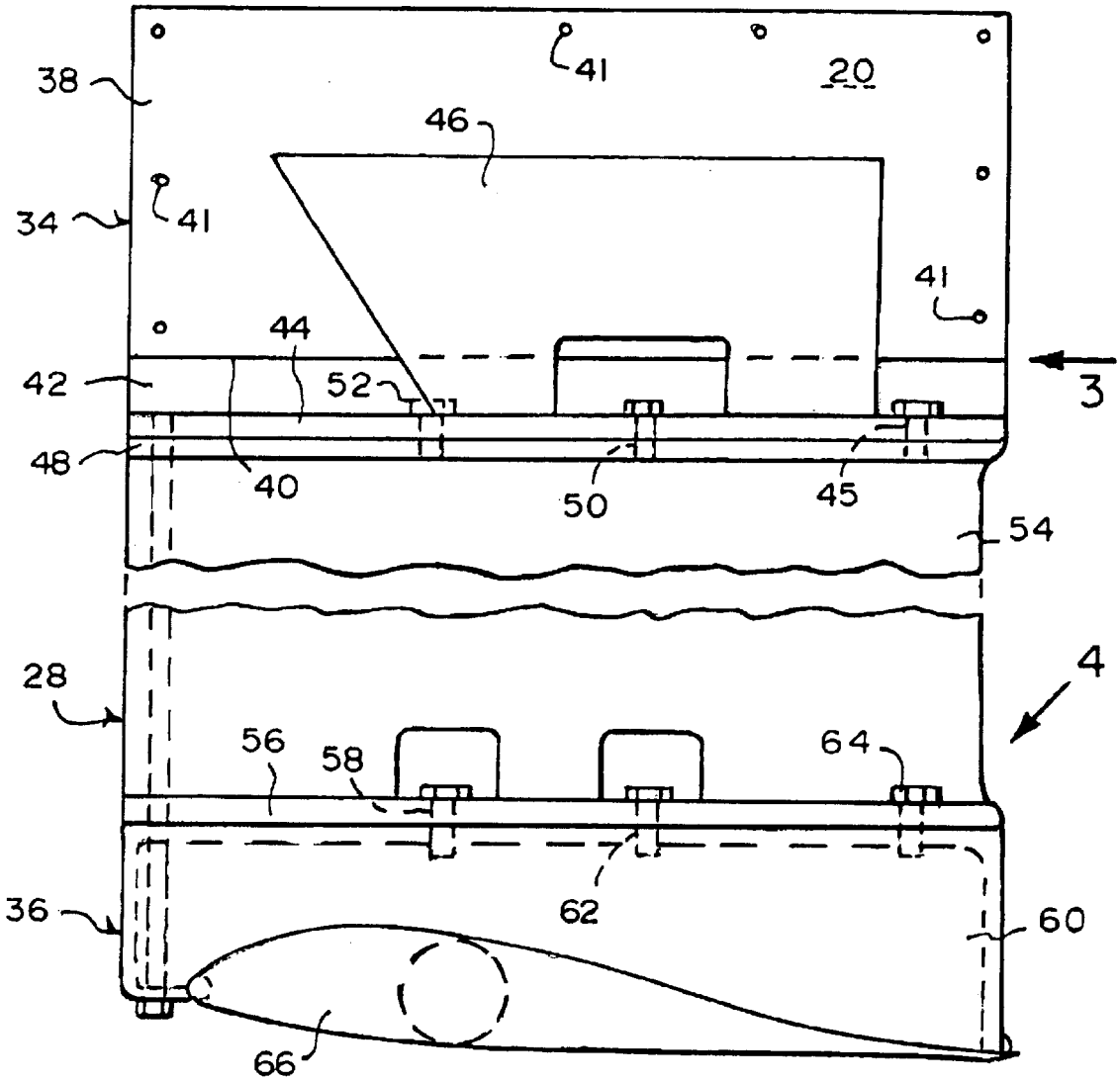
FIG. 2 is an enlarged diagrammatic side elevational view taken generally in the direction of arrow 2 in FIG. 1 of the front hydrofoil unit of the present invention.

The overall configuration of the front hydrofoil unit 28 can best be seen in FIG. 2, and as such, will be discussed with reference thereto.

The front hydrofoil unit 28 comprises a mounting portion 34 and a hydrofoil portion 36. The mounting portion 34 of the front hydrofoil unit 28 is for mounting to, and for depending from, the bottom 20 of the hull 18 at the bow 22 thereof. The hydrofoil portion 36 of the front hydrofoil unit 28 mounts to, and depends from, the mounting portion 34 of the front hydrofoil unit 28.

Figure 3:
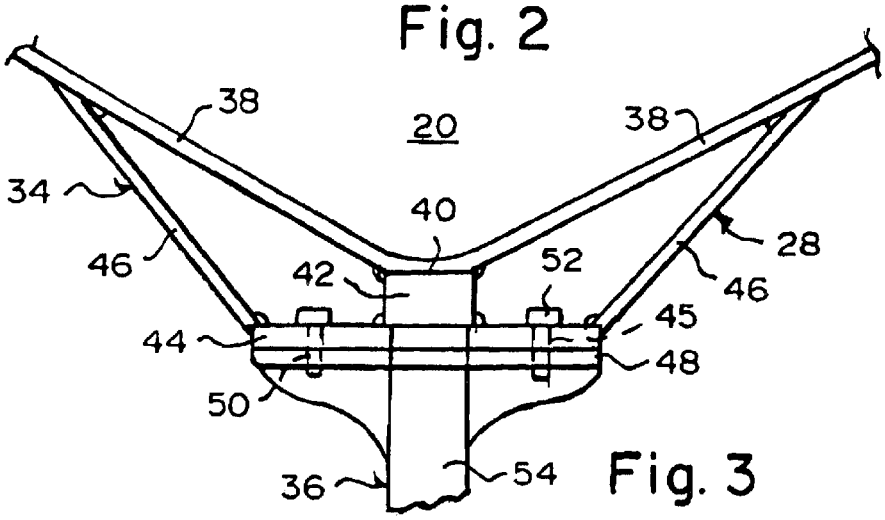
FIG. 3 is diagrammatic rear elevational view taken generally in the direction of arrow 3 in FIG. 2 of the mounting point of the front hydrofoil unit of the present invention.

The specific configuration of the mounting portion 34 of the front hydrofoil unit 28 can best be seen in FIGS. 2 and 3, and as such, will be discussed with reference thereto.

The mounting portion 34 of the front hydrofoil unit 28 comprises a pair of upper plates 38. The pair of upper plates 38 of the mounting portion 34 of the front hydrofoil unit 28 are disposed in a V-shape along a common edge 40 thereof, are for mounting to, and for depending from, the bottom 20 of the hull 18 at the bow 22 thereof, and have through bores 41 for this purpose.

The mounting portion 34 of the front hydrofoil unit 28 further comprises a stanchion 42. The stanchion 42 of the mounting portion 34 of the front hydrofoil unit 28 depends along the common edge 40 of the pair of upper plates 38 of the mounting portion 34 of the front hydrofoil unit 28.

The mounting portion 34 of the front hydrofoil unit 28 further comprises a lower plate 44. The lower plate 44 of the mounting portion 34 of the front hydrofoil unit 28 depends from the stanchion 42 of the mounting portion 34 of the front hydrofoil unit 28 and contains through bores 45.

The mounting portion 34 of the front hydrofoil unit 28 further comprises a pair of struts 46. The pair of struts 46 of the mounting portion 34 of the front hydrofoil unit 28 extend from the pair of upper plates 38 of the mounting portion 34 of the front hydrofoil unit 28 to the lower plate 44 of the mounting portion 34 of the front hydrofoil unit 28, respectively.

Figure 4:
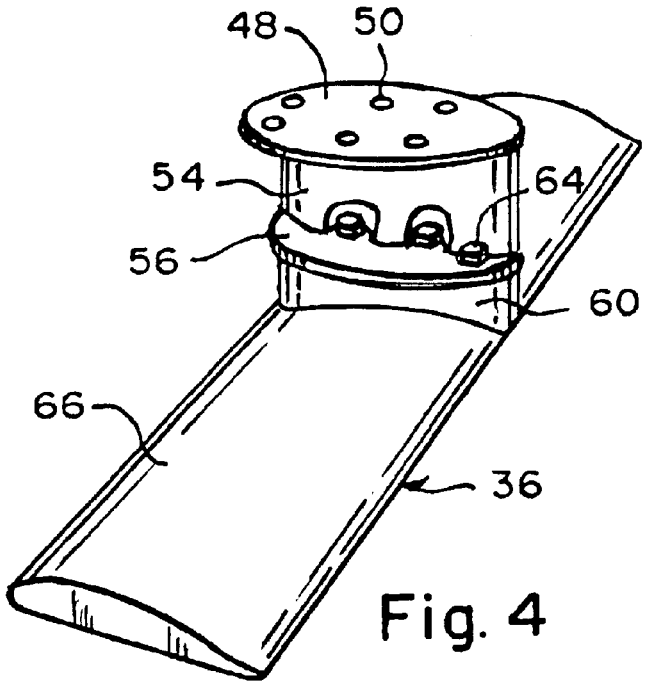
FIG. 4 is a diagrammatic perspective view of the area generally pointed to by arrow 4 in FIG. 2 of the hydrofoil portion of the front hydrofoil unit of the present invention.

The specific configuration of the hydrofoil portion 36 of the front hydrofoil unit 28 can best be seen in FIGS. 2 and 4, and as such, will be discussed with reference thereto.

The hydrofoil portion 36 of the front hydrofoil unit 28 comprises an upper plate 48. The upper plate 48 of the hydrofoil portion 36 of the front hydrofoil unit 28 attaches to, and depends from, the lower plate 44 of the mounting portion 34 of the front hydrofoil unit 28 and contains through bores 50 that align with the through bores 45 in the lower plate 44 of the mounting portion 34 of the front hydrofoil unit 28 so as to form aligned through bores that receive upper bolts 52.

The hydrofoil portion 36 of the front hydrofoil unit 28 further comprises an extension 54. The extension 54 of the hydrofoil portion 36 of the front hydrofoil unit 28 depends from the upper plate 48 of the hydrofoil portion 36 of the front hydrofoil unit 28.

The hydrofoil portion 36 of the front hydrofoil unit 28 further comprises a lower plate 56. The lower plate 56 of the hydrofoil portion 36 of the front hydrofoil unit 28 depends from the extension 54 of the hydrofoil portion 36 of the front hydrofoil unit 28 and has through bores 58.

The hydrofoil portion 36 of the front hydrofoil unit 28 further comprises a stanchion 60. The stanchion 60 of the hydrofoil portion 36 of the front hydrofoil unit 28 attaches to, and depends from, the lower plate 56 of the hydrofoil portion 36 of the front hydrofoil unit 28 and has through bores 62 that align with the through bores 58 in the lower plate 56 of the hydrofoil portion 36 of the front hydrofoil unit 28 so as to form aligned through bores that receive lower bolts 64.

The hydrofoil portion 36 of the front hydrofoil unit 28 further comprises a hydrofoil 66. The hydrofoil 66 of the hydrofoil portion 36 of the front hydrofoil unit 28 depends from, and extends equidistantly out from, the stanchion 60 of the hydrofoil portion 36 of the front hydrofoil unit 28.

Figure 5:
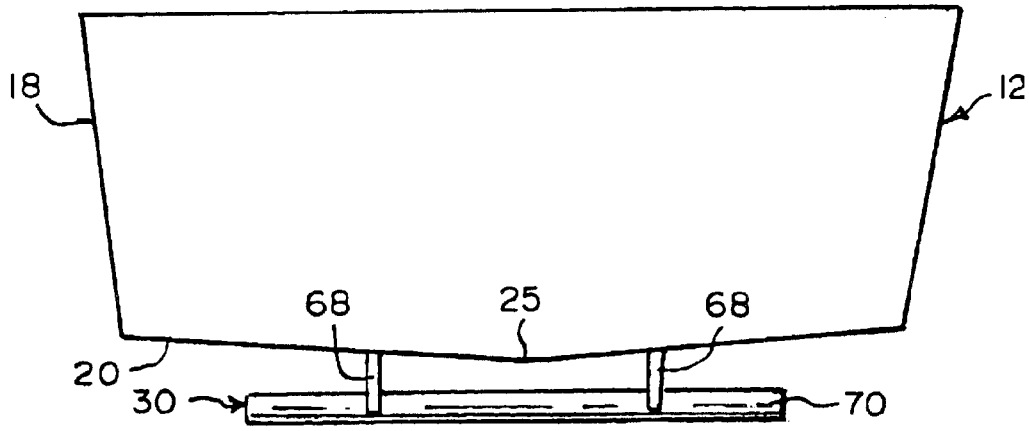
FIG. 5 is an enlarged diagrammatic cross sectional view taken along line 5—5 in FIG. 1 of the center hydrofoil unit of the present invention.

The specific configuration of the center hydrofoil unit 30 can best be seen in FIG. 5, and as such, will be discussed with reference thereto.

The center hydrofoil unit 30 comprises a pair of stanchions 68 and a hydrofoil 70. The pair of stanchions 68 of the center hydrofoil unit 30 are for mounting to, for depending from, and for straddling, the bottom 20 of the hull 18 at the substantial center 25 thereof.

The hydrofoil 70 of the center hydrofoil unit 30 depends from, and extends equidistantly outwardly from, the pair of stanchions 68 of the center hydrofoil unit 30.

Figure 6:
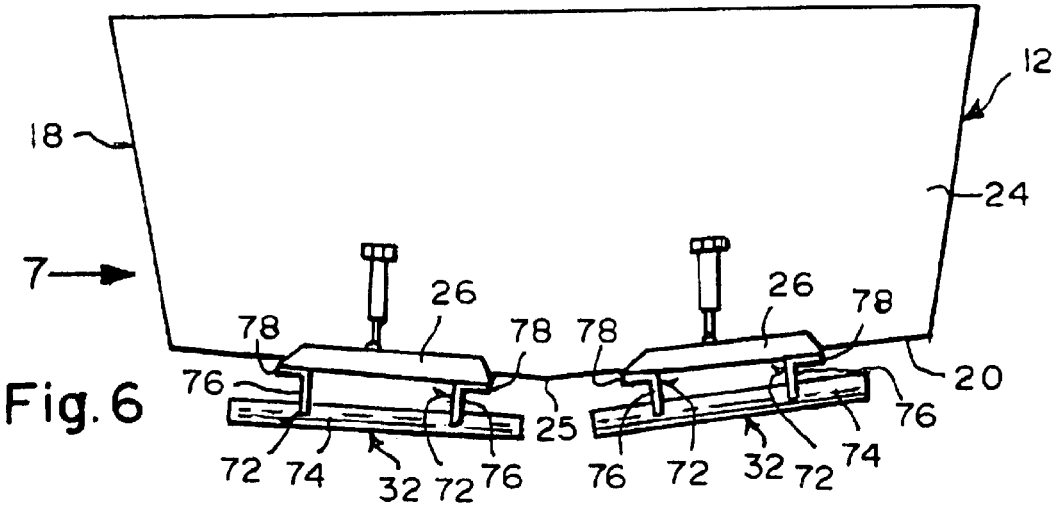
FIG. 6 is an enlarged diagrammatic rear elevational view taken generally in the direction of arrow 6 in FIG. 1 of the pair of rear hydrofoil units of the present invention.
Figure 7:
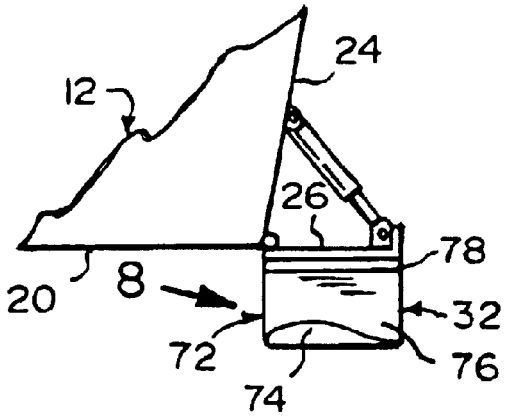
FIG. 7 is a diagrammatic side elevational view taken generally in the direction of arrow 7 in FIG. 6 of a rear hydrofoil unit of the present invention.
Figure 8:
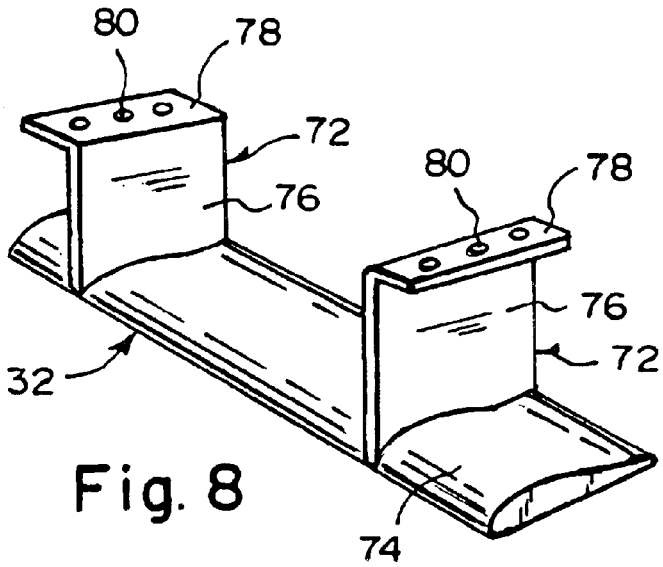
FIG. 8 is an enlarged diagrammatic perspective view, taken generally in the direction of arrow 8 in FIG. 7, of the hydrofoil portion of a rear hydrofoil unit of the present invention.

The specific configuration of each of the pair of rear hydrofoil units 32 can best be seen in FIGS. 6–8, and as such, will be discussed with reference thereto.

Each rear hydrofoil unit 32 comprises a pair of stanchions 72 and a hydrofoil 74. The pair of stanchions 72 of each rear hydrofoil unit 32 are for mounting to, and for depending from, an associated one of the port and starboard trim tabs 26.

Each stanchion 72 of each rear hydrofoil unit 32 is inverted L-shaped, and has a vertical portion 76 and a horizontal portion 78 that extends outwardly from the vertical portion 76 thereof. The horizontal portion 78 of each stanchion 72 of each rear hydrofoil unit 32 has through bores 80 for receiving screws (not shown) for attaching the pair of rear hydrofoil units 32 to the port and starboard trim tabs 26, respectively.

The hydrofoil 74 of each rear hydrofoil unit 32 depends from, and extends equidistantly outwardly from, the pair of stanchions 72 of an associated rear hydrofoil unit 32.

It will be understood that each of the elements described above, or two or more together, may also find a useful application in other types of constructions differing from the types described above.

While the invention has been illustrated and described as embodied in a hydrofoil system for lifting a boat out of water an amount sufficient to reduce drag while still allowing the boat to be powered by a conventional inboard-outboard drive, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hydrofoil system for lifting a boat out of water an amount sufficient to reduce drag while still allowing the boat to be powered by a conventional inboard-outboard drive, wherein the boat has a hull with a bottom, a bow, a stern with port and starboard trim tabs, and a substantial center which is intermediate the bow of the hull and the stern of the hull, said system comprising:

a) a front hydrofoil units;

b) a center hydrofoil unit; and c) a pair of rear hydrofoil units;

wherein said front hydrofoil unit depends from the bottom of the hull at the bow thereof;

wherein said pair of rear hydrofoil units depend from the port and starboard trim tab units of the hull, respectively; and wherein said center hydrofoil unit depend from the bottom of the hull at the substantial center thereof, wherein said front hydrofoil unit comprises a mounting portion;

wherein said front hydrofoil unit comprises a hydrofoil portion;

wherein said mounting portion of said front hydrofoil unit is for mounting to the bottom of the hull at the bow thereof;

wherein said mounting portion of said front hydrofoil unit depends from the bottom of the hull at the bow thereof;

wherein said hydrofoil portion of said front hydrofoil unit mounts to said mounting portion of said front hydrofoil unit; and wherein said hydrofoil portion of said front hydrofoil unit depends from said mounting portion of said front hydrofoil unit, wherein said mounting portion of said front hydrofoil unit comprises a pair of upper plates;

wherein said pair of upper plates of said mounting portion of said front hydrofoil unit are disposed in a V-shape along a common edge thereof;

wherein said pair of upper plates of said mounting portion of said front hydrofoil unit are for mounting to the bottom of the hull at the bow thereof; and wherein said pair of upper plates of said mounting portion of said front hydrofoil unit depend from the bottom of the hull at the bow thereof.

2. The system as defined in claim 1, wherein said pair of upper plates of said mounting portion of said front hydrofoil unit have through bores.

3. The system as defined in claim 1, wherein said mounting portion of said front hydrofoil unit comprises a stanchion; and wherein said stanchion of said mounting portion of said front hydrofoil unit depends along said common edge of said pair of upper plates of said mounting portion of said front hydrofoil unit.

4. The system as defined in claim 3, wherein said mounting portion of said front hydrofoil unit comprises a lower plate; and wherein said lower plate of said mounting portion of said front hydrofoil unit depends from said stanchion of said mounting portion of said front hydrofoil unit.

5. The system as defined in claim 4, wherein said lower plate of said mounting portion of said front hydrofoil unit contains through bores.

6. The system as defined in claim 5, wherein said hydrofoil portion of said front hydrofoil unit comprises an upper plate;

wherein said upper plate of said hydrofoil portion of said front hydrofoil unit attaches to said lower plate of said mounting portion of said front hydrofoil unit; and wherein said upper plate of said hydrofoil portion of said front hydrofoil unit depends from said lower plate of said mounting portion of said front hydrofoil unit.

7. The system as defined in claim 6, wherein said upper plate of said hydrofoil portion of said front hydrofoil unit contains through bores;

wherein said through bores in said upper plate of said hydrofoil portion of said front hydrofoil unit align with said through bores in said lower plate of said mounting portion of said front hydrofoil unit so as to form aligned through bores; and wherein said aligned through bores receive upper bolts.

8. The system as defined in claim 6, wherein said hydrofoil portion of said front hydrofoil unit comprises an extension; and wherein said extension of said hydrofoil portion of said front hydrofoil unit depends from said upper plate of said hydrofoil portion of said front hydrofoil unit.

9. The system as defined in claim 8, wherein said hydrofoil portion of said front hydrofoil unit comprises a lower plate; and wherein said lower plate of said hydrofoil portion of said front hydrofoil unit depends from said extension of said hydrofoil portion of said front hydrofoil unit.

10. The system as defined in claim 9, wherein said lower plate of said hydrofoil portion of said front hydrofoil unit has through bores.

11. The system as defined in claim 10, wherein said hydrofoil portion of said front hydrofoil unit comprises a stanchion;

wherein said stanchion of said hydrofoil portion of said front hydrofoil unit attaches to said lower plate of said hydrofoil portion of said front hydrofoil unit; and wherein said stanchion of said hydrofoil portion of said front hydrofoil unit depends from said lower plate of said hydrofoil portion of said front hydrofoil unit.

12. The system as defined in claim 11, wherein said stanchion of said hydrofoil portion of said front hydrofoil unit has through bores;

wherein said through bores in said stanchion of said hydrofoil portion of said front hydrofoil unit align with said through bores in said lower plate of said hydrofoil portion of said front hydrofoil unit so as to form aligned through bores; and wherein said aligned through bores receive lower bolts.

13. The system as defined in claim 11, wherein said hydrofoil portion of said front hydrofoil unit comprises a hydrofoil;

wherein said hydrofoil of said hydrofoil portion of said front hydrofoil unit depends from said stanchion of said hydrofoil portion of said front hydrofoil unit; and wherein said hydrofoil of said hydrofoil portion of said front hydrofoil unit extends equidistantly out from said stanchion of said hydrofoil portion of said front hydrofoil unit.

14. The system as defined in claim 4, wherein said mounting portion of said front hydrofoil unit comprises a pair of struts;

wherein said pair of struts of said mounting portion of said front hydrofoil unit extend from said pair of upper plates of said mounting portion of said front hydrofoil unit to said lower plate of said mounting portion of said front hydrofoil unit, respectively.

15. The system as defined in claim 1, wherein said center hydrofoil unit comprises a pair of stanchions;

wherein said center hydrofoil unit comprises a hydrofoil;

wherein said pair of stanchions of said center hydrofoil unit are for mounting to the bottom of the hull at the substantial center thereof;

wherein said pair of stanchions of said center hydrofoil unit depend from the bottom of the hull at the substantial center thereof; and wherein said pair of stanchions of said center hydrofoil unit are for straddling the bottom of the hull at the substantial center thereof.

16. The system as defined in claim 15, wherein said hydrofoil of said center hydrofoil unit depends from said pair of stanchions of said center hydrofoil unit; and wherein said hydrofoil of said center hydrofoil unit extends equidistantly outwardly from said pair of stanchions of said center hydrofoil unit.

17. The system as defined in claim 1, wherein each rear hydrofoil unit comprises a pair of stanchions;

wherein each rear hydrofoil unit comprises a hydrofoil;

wherein said pair of stanchions of each rear hydrofoil unit are for mounting to an associated one of the port and starboard trim tabs; and wherein said pair of stanchions of each rear hydrofoil unit depend from the associated one of the port and starboard trim tabs.

18. The system as defined in claim 17, wherein each stanchion of each rear hydrofoil unit is inverted L-shaped;

wherein each stanchion of each rear hydrofoil unit has a vertical portion;

wherein each stanchion of each rear hydrofoil unit has a horizontal portion; and wherein said horizontal portion extends outwardly from said vertical portion thereof.

19. The system as defined in claim 18, wherein said horizontal portion of each stanchion of each rear hydrofoil unit has through bores; and wherein said through bores in said horizontal portion of each stanchion of each rear hydrofoil unit are for receiving screws for attaching said pair of rear hydrofoil units to the port and starboard trim tabs, respectively.

20. The system as defined in claim 18, wherein said hydrofoil of each rear hydrofoil unit depends from said pair of stanchions of an associated rear hydrofoil unit; and wherein said hydrofoil of each rear hydrofoil unit extends equidistantly outwardly from said pair of stanchions of said associated rear hydrofoil unit.

* * * * *